US007269940B2

(12) United States Patent
Wiseman

(10) Patent No.: US 7,269,940 B2
(45) Date of Patent: Sep. 18, 2007

(54) ION ENGINE GRID ARCING PROTECTION CIRCUIT

(75) Inventor: Steven L. Wiseman, Redondo Beach, CA (US)

(73) Assignee: L-3 Communications Electron Technologies, Inc., Torrance, CA (US)

( * ) Notice: Subject to any disclaimer, the term of this patent is extended or adjusted under 35 U.S.C. 154(b) by 461 days.

(21) Appl. No.: 10/961,292

(22) Filed: Oct. 7, 2004

(65) Prior Publication Data

US 2006/0075739 A1 Apr. 13, 2006

(51) Int. Cl.
*F03H 1/00* (2006.01)

(52) U.S. Cl. ..... 60/202; 60/204

(58) Field of Classification Search ..... 60/202, 60/204

See application file for complete search history.

(56) References Cited

U.S. PATENT DOCUMENTS 2,911,561 A * 11/1959 Fathauer ..... 315/10
3,052,088 A 9/1962 Davis et al.
3,156,090 A 11/1964 Kaufman
4,314,180 A * 2/1982 Salisbury ..... 376/130
4,838,021 A 6/1989 Beattie
5,369,953 A * 12/1994 Brophy ..... 60/202
5,465,023 A * 11/1995 Garner ..... 313/293
5,947,421 A * 9/1999 Beattie et al. ..... 244/171.1
6,304,040 B1 * 10/2001 Cardwell et al. ..... 315/290
2002/0074508 A1 * 6/2002 Kahn et al. ..... 250/423 R
2003/0102402 A1 * 6/2003 Williams et al. ..... 244/3.1

* cited by examiner

*Primary Examiner*—William H. Rodriguez
(74) *Attorney, Agent, or Firm*—Proskauer Rose LLP

(57) ABSTRACT

An arcing protection circuit for the screen and accelerator grids of an ion thruster engine includes an impedance, which in one embodiment, is fixed, and in another, is variable, coupled in series between the accelerator grid of the engine and a current return path of the grid in such a way that an increase in accelerator grid current resulting from a plasma arc occurring between the screen grid and the accelerator grid is converted by the impedance into a rapid reduction in the voltage difference between the screen and accelerator grids, thereby extinguishing the arc. The arcing protection circuit also includes a monitoring circuit coupled to the accelerator grid that senses an increase in the voltage on the accelerator grid resulting from the plasma arc, and in response thereto, causes the accelerator grid power supply to reduce the voltage on the accelerator grid.

20 Claims, 2 Drawing Sheets

ION ENGINE GRID ARCING PROTECTION CIRCUIT

BACKGROUND OF THE INVENTION

1. Field of the Invention

This invention relates to ion thruster engines in general, and in particular, to a circuit that couples to the accelerator grid of an ion engine in such a way that the voltage difference, and hence, the energy contained in a plasma arc occurring between the screen grid and the accelerator grid of the engine, is minimized, thereby reducing or eliminating the damage to the grids caused by such arcing.

2. Related Art

In accordance with well-known Newtonian principles, if electrically charged particles, or ions, are accelerated to a high velocity in a vehicle and then discharged from it, the vehicle will be propelled in a direction opposite to that of the discharged particles, thus giving rise to the development of "electrostatic," or "ion thruster" engines for space vehicles. While such engines can produce only a very small amount of thrust compared to that produced by the larger and more familiar chemical rocket engines, they are capable of operating continuously for substantially longer periods of time than the latter, and additionally, have a favorably high "specific impulse" ("$I_{SP}$") figure when compared to the latter, where $I_{SP}$ is the ratio of thrust to the rate of use of propellant. Thus, while ion engines may lack the large thrust necessary to lift a heavy payload into orbit, they nevertheless have wide application in deep space missions, such as interplanetary exploration, and in orbital satellites for orbital positioning and attitude control, where engine "burns" may last for days, weeks, or even years. Exemplary ion thruster engines are discussed in, e.g., U.S. Pat. No. 4,838,021 to J. Beattie; U.S. Pat. No. 3,156,090 to H. Kaufmann; and, U.S. Pat. No. 3,052,088 to J. Davis et al.

A typical ion engine comprises an ionization chamber having a pair of separate, spaced-apart, fenestrated electrodes, or "grids" having respective, aligned apertures therein, viz., a "screen" grid and an "accelerator" grid, disposed at one end thereof. The two grids are charged with voltages of opposite polarities such that a relatively large voltage potential, and hence, a strong electric field, exists between the two grids. A "propellant," e.g., gaseous xenon or mercury atoms, is introduced into the chamber, where it is ionized to produce a plasma. The ionized particles form a neutral plasma, which essentially fills the chamber. The propellant ions that pass through the apertures of the screen grid, and thence, into the strong electric field between the two grids, are forcefully accelerated from the chamber through the apertures in the accelerator grid, resulting in a reactive thrust being applied to the ionization chamber.

During operation of the engine, the accelerator grid is normally subject to some erosion caused by "charge-exchange" ions. This erosion is exhibited as a pattern of pits and grooves that occurs on the surfaces of the grids. In addition to this "normal" type of wear of the engine, electrical plasma arcs occasionally occur between the screen and accelerator grids. These arcs are caused by various operational anomalies occurring in the engine, and can cause additional damage to the screen and accelerator grids over and above that caused by the normal charge-exchange ion erosion described above. This additional type of damage to the grids has been shown to make the occurrence of plasma arcs between the grids more frequent by degrading the high voltage integrity of the screen-grid-to-accelerator-grid interface. Such damage can result in a substantial reduction in the reliability and operational life of the engine.

A long-felt but as yet unsatisfied need therefore exists in this field for a reliable, low-cost and lightweight mechanism for reducing the energy contained in a plasma arc occurring between the accelerator grid and the screen grid of an ion engine, thereby minimizing or eliminating the damage caused to the grids of the engine by arcing.

BRIEF SUMMARY OF THE INVENTION

In accordance with the present invention, a circuit is provided that couples to the accelerator grid of an ion engine in such a way that the voltage differential, and hence, the energy contained in a plasma arc occurring between the screen grid and the accelerator grid of the engine, is minimized, thereby reducing or eliminating the damage to the grids caused by the arc.

In a first exemplary embodiment thereof, the novel grid arcing protection circuitry includes a protection circuit that comprises a fixed impedance in series between the accelerator grid and the output of the internal accelerator power source within the ion thruster. During an arc between the accelerator grid and screen grid of the ion thruster, the added impedance causes a rapid reduction in the voltage of the accelerator grid relative to that of the screen grid.

While it is desirable to have the added impedance present in the arc protection circuit during normal operation of the ion engine, it may be desirable to reduce its impedance during startup of the engine, so that the accelerator grid current can quickly achieve a relatively high startup level for a brief period of time required for the engine to start. For this purpose, the arcing protection circuit further includes a circuit for selectably coupling the impedance into and out of the accelerator grid-to-accelerator-supply output path, and in one possible embodiment, this impedance coupling circuit may comprise a simple relay.

The accelerator grid voltage is regulated at the required voltage while the fixed impedance is in series with the accelerator grid or when the fixed impedance is switched out of the accelerator-grid-to-accelerator-supply output path. This is accomplished by an error amplifier, which senses the voltage at the accelerator grid and provides a feedback signal proportional to the accelerator grid voltage that enables the magnitude of the internal accelerator power source within the ion thruster to be varied to maintain the accelerator grid at its required voltage during all modes of operation.

In an alternative exemplary embodiment, the grid arcing protection circuit can advantageously incorporate, in addition to the above accelerator grid monitoring circuit of the first embodiment, a variable impedance in place of the fixed impedance. As in the first embodiment, this impedance is coupled in series between the accelerator grid and the output of the internal accelerator power source within the ion thruster, the difference in this embodiment being that the impedance is variable. During a plasma arc between the screen and accelerator grids, the plasma arc causes the impedance of the circuit to increase rapidly. This action quickly reduces the relative voltage difference between the accelerator grid and the screen grid, thereby extinguishing or substantially limiting the energy of the arc almost instantaneously.

Advantageously, the accelerator grid voltage is regulated at the required voltage by the accelerator grid monitoring circuit, while the variable impedance is in series with the accelerator grid, by an error amplifier, which senses the voltage at the accelerator grid and provides a feedback signal proportional to the accelerator grid voltage that enables the magnitude of the internal accelerator power source within the ion thruster to be varied so as to maintain the accelerator grid at its required voltage during normal operation.

In one advantageous embodiment thereof, the variable impedance comprises an electrically actuated switch. The active switch may comprise a plurality of first transistors, which may be MOSFETs or Bipolar Junction Transistors, ("BJTs"), coupled in series between the accelerator grid and the output of the internal accelerator power source within the ion thruster. These transistors have their respective bases coupled in parallel and biased such that they operate in the fully saturated mode during normal thruster operation. A second transistor is coupled between the bases of the first transistor and the output of the internal accelerator power source within the ion thruster. A pulse transformer is also included, which has a primary winding coupled in series between the accelerator grid and the collector of the first transistor in the variable impedance string of transistors. The excess current during a plasma arc is sensed by the pulse transformer, with the secondary of the pulse transformer connected directly to the second transistor and a base circuit of the second transistor. The second transistor is coupled between the bases of the first transistors in the variable impedance string, which is connected to the internal accelerator power source within the ion thruster; the action of the pulse transformer being used to turn off all of the transistors in the variable impedance string rapidly. This action quickly reduces the voltage difference between the accelerator grid relative to the screen grid, thereby almost instantaneously extinguishing or substantially limiting the energy of the arc.

A better understanding of the above and many other features and advantages of the grid arc protection circuit of the present invention may be obtained from a consideration of the detailed description thereof below, particularly if such consideration is made in conjunction with the several views of the appended drawings.

DETAILED DESCRIPTION OF THE INVENTION

Figure 1:
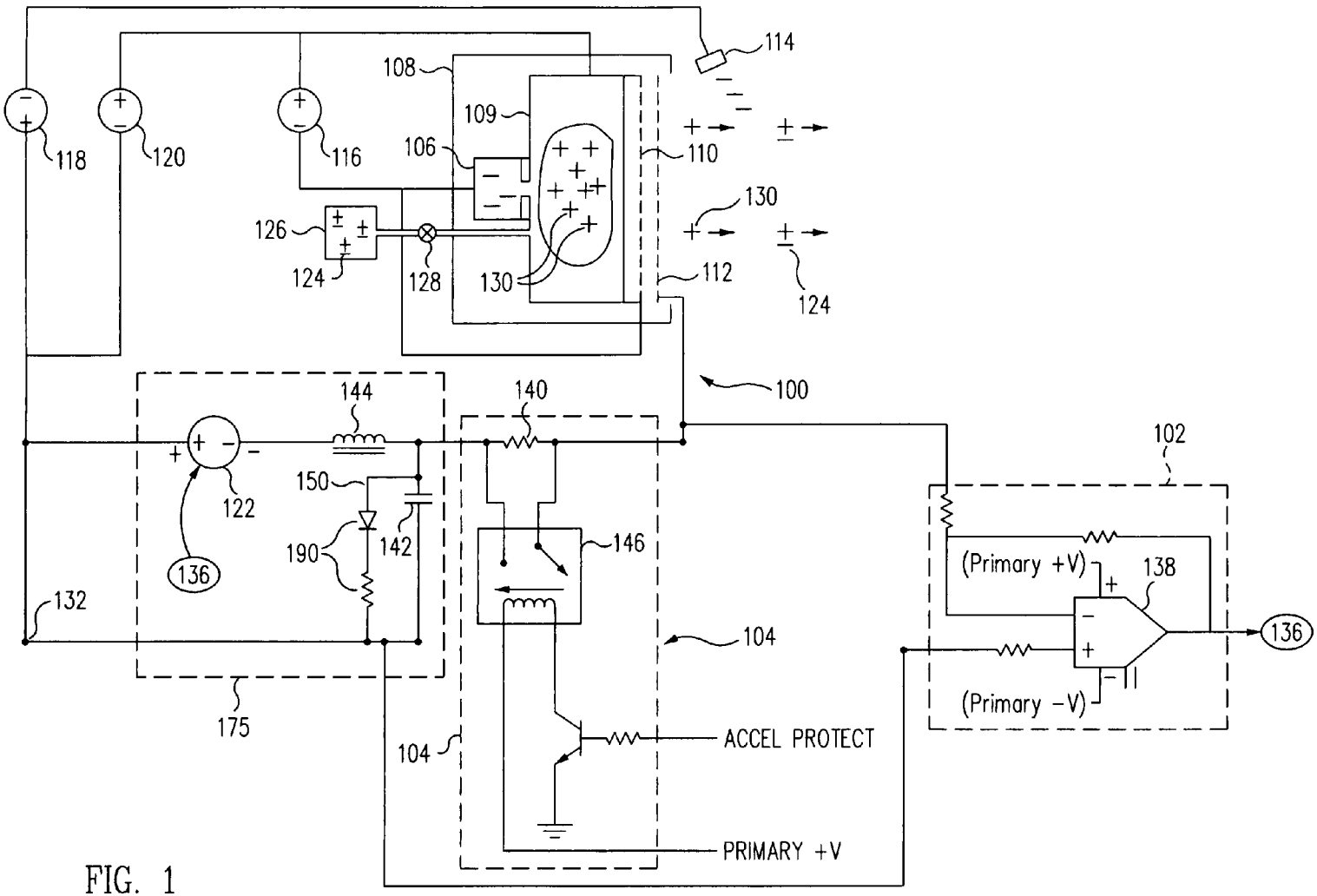
FIG. 1 is a schematic diagram of an ion thruster engine incorporating a grid arcing protection circuit in accordance with a first exemplary embodiment of the present invention; and, FIG. 2 is a schematic diagram of an ion thruster engine incorporating a grid arcing protection circuit in accordance with a second exemplary embodiment of the present invention.

An ion thruster engine 100 incorporating a grid arcing protection circuit 102 and 104 in accordance with a first exemplary embodiment of the present invention is illustrated in the schematic diagram of FIG. 1. The ion engine 100 comprises a discharge cathode 106, for the production of free electrons, disposed at a closed end of a hollow ionization chamber 108 containing a discharge anode 109 (shown with broken-away sidewall in the figure). The discharge chamber is closed at the opposite, "discharge" end by a pair of separate, fenestrated electrodes, or grids, viz., a "screen" grid 110 and an "accelerator" grid 112. A second, neutralizer cathode 114, also for the production of free electrons, is disposed adjacent to the exterior surface of the accelerator grid 112. The discharge cathode is provided with a negative voltage with respect to the anode by a discharge power supply 116 and a neutralizer power supply 118. The anode of the ionization chamber is supplied with a positive voltage by a parallel screen power supply 120. The screen grid 110 is supplied with a positive voltage that is less than, or "offset" from, the screen supply voltage by the voltage of the discharge supply. The accelerator grid 112 is supplied with a negative voltage relative to the screen grid 110 by an accelerator grid power supply 122, thereby creating a strong electrostatic field between the screen and accelerator grids.

Electrically neutral atoms of a propellant 124, e.g., gaseous xenon or mercury, are stored under pressure in a storage container 126 and introduced through a control valve 128 into the ionization chamber 108 adjacent to the discharge cathode 106, where they collide with electrons generated by the discharge cathode to produce a plasma containing ions 130, i.e., positively ionized atoms of the propellant. The positively charged ions form a neutral plasma, which essentially fills the discharge chamber. The propellant ions that pass through the apertures of the screen grid, and thence, into the strong electric field between the two grids, are forcefully accelerated from the discharge chamber through the apertures in the accelerator grid, resulting in a reactive thrust. As the propellant ions exit the accelerator grid, they are neutralized, i.e., rendered electrically neutral again, by electrons produced by the neutralizer cathode 114, so that that the ion engine 100, and the spacecraft to which it is attached, are maintained at a neutral electrostatic potential.

While the particular parameters may vary widely, depending on the particular ion engine 100 under consideration, a typical value for the voltage supplied by the screen power supply 120 is +1800 Volts DC (VDC). A typical discharge power supply 116 voltage is +25 VDC. This results in a net screen grid 110 voltage of approximately +1775 VDC with respect to a neutralizer supply 118 current return path, or "neutralizer common" return 132. A typical value for the voltage supplied by the accelerator supply 122 to the accelerator grid 112 is −250 VDC with respect to the neutralizer common. This results in a relative screen-grid-to-accelerator-grid voltage differential of approximately 2000 VDC.

During operation of the ion engine 100, plasma arcs can occur between the screen and accelerator grids 110, 112. These arcs are caused by various operational anomalies occurring in the engine, and can cause additional damage to the screen and accelerator grids over and above that caused by the normal charge-exchange ion erosion described above. This additional type of damage to the grids has been shown to make the occurrence of plasma arcs between the grids more frequent by degrading the high voltage integrity of the screen-grid-to-accelerator-grid interface. Such damage can result in a substantial reduction in the reliability and operational life of the engine. A first embodiment of a grid arcing protection circuit, comprising two parts 102 and 104, for preventing or reducing this type of damage to the grids is outlined by the dashed lines of FIG. 1.

As illustrated in FIG. 1, in addition to a monitoring and sensing circuit 102 above, there is an arc protection circuit 104. The arc protection circuit 104 comprises a fixed impedance 140 and a controllable relay 146. When the relay 146 is open, the high impedance 140 is in the protection circuit. The purpose of the high impedance 140 is to reduce the energy contained within an arc between the screen grid and accelerator grid. During an arc, the high impedance 140 will cause the voltage difference between the screen grid and accelerator grid to decrease, thereby almost instantaneously extinguishing or substantially limiting the energy of the arc.

Referring again to FIG. 1, the purpose of the voltage monitoring and regulating circuit 102 is to directly sense the accelerator voltage and to provide a feedback signal to the control circuitry of the accelerator supply 122, such that the accelerator voltage can be regulated and held at the required voltage for the thruster to operate properly during all modes of operation. As a result, the effect of the high impedance, which is included in the circuit during normal operation, has no effect on the magnitude of the voltage that is supplied to the accelerator grid. The inductor 144 and capacitor 142 function as an output filter for the accelerator supply 122 such that the pulsating output from the supply can be filtered to a DC voltage level. The diode and resistor 190 are included in the circuit so that during an arc, an output voltage 150 of the accelerator supply 122 does not go to a highly positive voltage. The relay 146 is controlled by control logic such that, during the start up sequence of the ion engine, the high impedance 140 is switched out of the circuit, that is, the relay 146 is closed. This is necessary because, during start up, the current requirements of the accelerator supply 122 increase for a short period of time. After the ion engine has started, the required accelerator supply current drops to a very low level, typically less than 25 milliamps ("mA"), and the relay 146 can be opened, thereby switching the high impedance 140 into the circuit. For example, if the resistor 140 is 2000 ohms and the normal accelerator current is 25 mA, the voltage drop across the resistor will be about 50 VDC. Thus, if the required accelerator grid voltage normally required were −250 VDC, the voltage that the regulated accelerator power supply would have to provide would be about −300 VDC. The power dissipation in the resistor would be approximately 1.25 Watts. If during an arc, the current increased to 1.0 Amp, the resulting voltage drop across the resistor 140 would be 2000 Volts. This action would instantaneously decrease the voltage difference between the accelerator grid and the screen grid by 2000 volts, thus accomplishing the objective of limiting the energy contained within the arc and extinguishing the arc completely. This action reduces or eliminates the damage caused to the grids by the arc.

Figure 2:
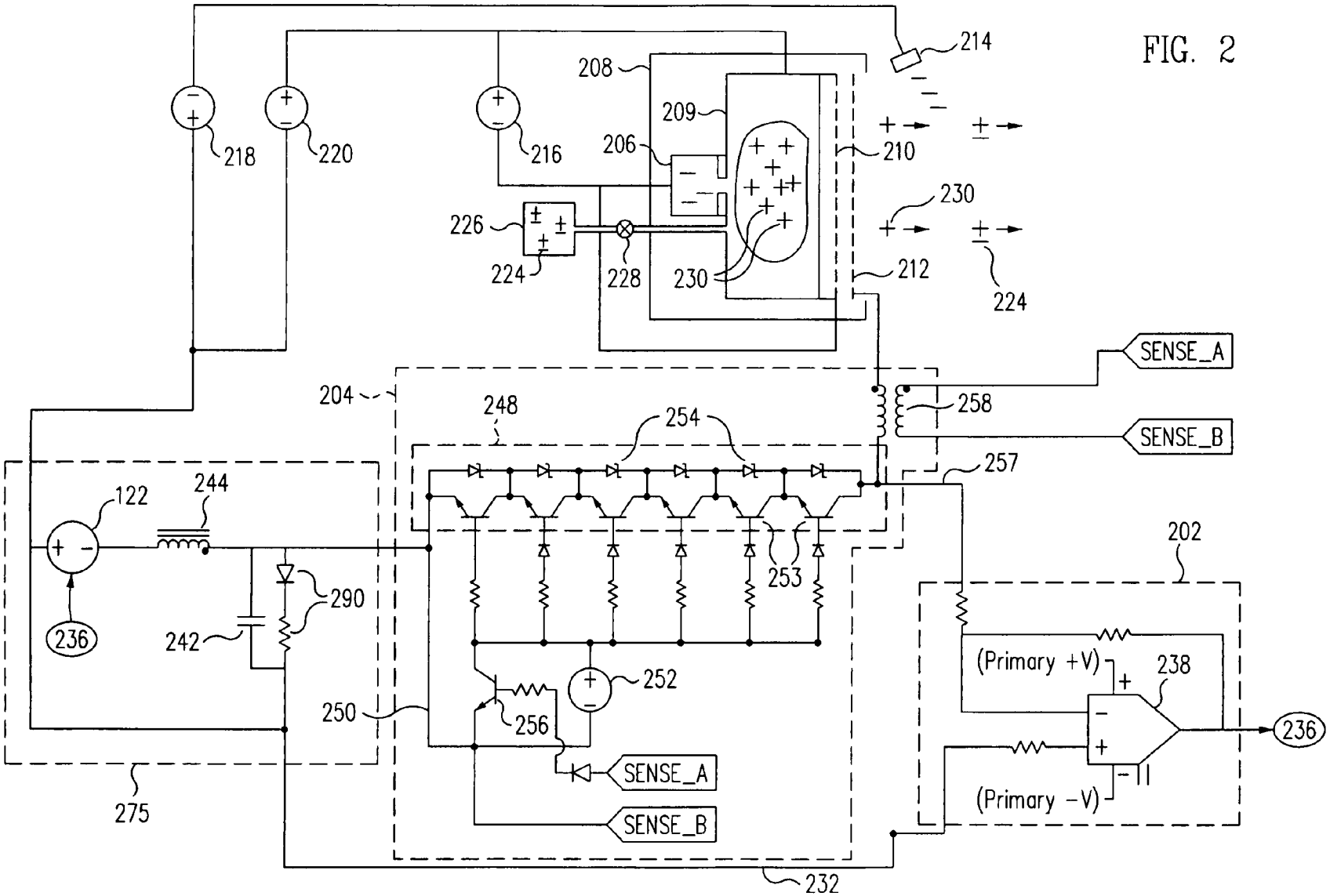

An alternative embodiment of a grid arcing protection circuit 204 for an ion thruster engine is illustrated in FIG. 2, wherein the same or similar elements to those described above have the same or similar reference number, but incremented by 100. As in the first embodiment, the arcing protection circuit of the second embodiment includes an accelerator grid 212 monitoring circuit 202, comprising an operational amplifier 238 voltage amplifier circuit coupled between the accelerator grid 212 and a current return path 232 (viz., the neutralizer return). As illustrated in FIG. 2, the second part of the arc protection circuit comprises a variable impedance coupled between the accelerator grid 212 and the output 250 of the accelerator power supply. In this embodiment, the resistive part of the impedance is made to increase in response to an increase in accelerator grid current resulting from a plasma arc between the screen grid and the accelerator grid. The action of increasing the impedance in the path from the accelerator grid 212 to the output 250 of the accelerator supply causes the voltage difference between the screen grid and accelerator grid to decrease, thereby almost instantaneously extinguishing or substantially limiting the energy of the arc.

The variable impedance comprises an electrically actuated switch 248 described in more detail below. The switch comprises a plurality of first transistors 253 coupled in series between the capacitor 242, which is at the output 250 of the accelerator power supply, and the accelerator grid 212, as illustrated in FIG. 2. The first transistors have their respective bases coupled in parallel and biased by a floating bias voltage 252 such that the first transistors operate in a fully saturated mode during normal engine operation. A plurality of zener diodes 254, each coupled in parallel with a respective one of the first transistors, may be provided to protect the first transistors from any extreme over-voltage condition during an arc condition. A second transistor 256 is coupled between the bases of the first transistors and the output 250 of the accelerator power supply. The switch further comprises a pulse transformer 258 having a primary winding coupled in series between the accelerator grid and the collector of the first transistor in the series string of transistors 253 of switch 248.

As in the first embodiment above, during normal operation of the engine 200, the power dissipated in the protection circuitry 204 is very low in comparison to the fixed impedance approach illustrated in FIG. 1. For example, if the accelerator current is 25 mA, the total voltage drop across the entire string of transistors will typically be about 5 to 10 volts. This results in a power dissipation of only about 0.25 Watts. However, during a plasma arc between the screen grid 210 and the accelerator grid 212, the current increases rapidly to a substantially higher level. This rapid increase of current through the pulse transformer 258 causes the secondary winding of the transformer 258 to apply an increased voltage to the base of the second transistor 256, causing it to conduct, thereby removing the bias voltage on the first transistors. Once the first transistor begins to turn off, all of the transistors are caused to turn off sharply, i.e., increasing the impedance of the transistor switch 248 substantially. This operation of the switch, in turn, causes the voltage on the accelerator grid to increase, i.e., become more positive, as in the first embodiment above, thereby resulting in a rapid reduction in the voltage differential between the screen and the accelerator grids. This reduction in turn, substantially diminishes the amount of energy contained in the plasma arc, and hence, the energy absorbed by the screen and accelerator grids during the arc, thereby eliminating or minimizing the damage caused to the grids by the arc. As above, a diode and resistor 290 are connected from the output 250 of the accelerator power source to the neutralizer return 232. The purpose of these parts is to limit the maximum positive voltage at the output 250 of the accelerator power supply to a low positive value during an arc.

As will by now be evident to persons of skill in this art, many modifications, substitutions and variations can be made in and to the materials, configurations and methods of implementation of the grid arcing protection circuit of the present invention without departing from its spirit and scope. For example, the first transistors 253 of the switch 248 of the second embodiment may be implemented either as BJTs or as MOSFETs, depending on the speed, current and voltage requirements of the particular problem at hand. Accordingly, the scope of the present invention should not be limited to the particular embodiments illustrated and described herein, as they are merely exemplary in nature, but rather, should be fully commensurate with that of the claims appended hereafter and their functional equivalents.

What is claimed is:

1. A grid-arcing protection circuit for an ion thruster engine of a type that includes a pair of spaced-apart screen and accelerator grids disposed at different voltages, the circuit comprising:

an impedance coupled in series between the accelerator grid and a current return path of the accelerator grid in such a way that a substantial portion of an increase in current in the accelerator grid resulting from a plasma arc between the screen grid and the accelerator grid is converted by the impedance into a rapid reduction in the voltage differential between the screen grid and the accelerator grid.

2. The arcing protection circuit of claim 1, wherein the impedance comprises a resistor.

3. The arcing protection circuit of claim 2, wherein the impedance further comprises a capacitor coupled in series with the resistor, and an inductor coupled in parallel with the resistor and the capacitor.

4. The arcing protection circuit of claim 2, further comprising a circuit for selectably coupling the resistor into and out of the protection circuit.

5. The arcing protection circuit of claim 4, wherein the resistor coupling circuit comprises a relay.

6. The arcing protection circuit of claim 1, further comprising a monitoring circuit coupled in series between the accelerator grid and a current return path of the accelerator grid and operable to sense an excess voltage on the accelerator grid resulting from the plasma arc, and in response thereto, to reduce the voltage differential between the screen grid and the accelerator grid.

7. The arcing protection circuit of claim 6, wherein the monitoring circuit comprises an operational amplifier.

8. A grid arcing protection circuit for an ion thruster engine of a type that includes a pair of spaced-apart screen and accelerator grids disposed at different voltages and polarities, the circuit comprising:

an impedance coupled in series between the accelerator grid and a current return path of the accelerator grid, the impedance being variable in response to an increase of current in the accelerator grid resulting from a plasma arc between the screen grid and the accelerator grid so as to decouple a substantial portion of the accelerator grid current from the return path and thereby rapidly reduce the voltage differential between the screen grid and the accelerator grid.

9. The arcing protection circuit of claim 8, wherein the impedance comprises an electrically actuated switch.

10. The arcing protection circuit of claim 9, wherein the impedance further comprises a capacitor coupled in series with the switch, and an inductor coupled in parallel with the switch and the capacitor.

11. The arcing protection circuit of claim 10, wherein the switch comprises:

a plurality of first transistors coupled in series between the capacitor and the accelerator grid current return path, the first transistors having respective bases coupled in parallel and biased such that the first transistors operate in a fully saturated mode;

a second transistor coupled between the bases of the first transistors and the accelerator grid current return path, the second transistor having a base; and, a pulse transformer having a primary winding coupled in series between the capacitor and the first transistors, and a secondary winding coupled in series between the base of the second transistor and the accelerator grid current return path.

12. The arcing protection circuit of claim 11, wherein at least one of the first transistors comprises a mosfet.

13. The arcing protection circuit of claim 11, wherein at least one of the first transistors comprises a bipolar junction transistor.

14. The arcing protection circuit of claim 11, further comprising a plurality of voltage regulator diodes, each coupled in parallel with a respective one of the first transistors.

15. The arcing protection circuit of claim 8, further comprising a monitoring circuit coupled to the accelerator grid and operable to sense an excess voltage on the accelerator grid resulting from the plasma arc, and in response thereto, to reduce the voltage differential between the screen grid and the accelerator grid.

16. The arcing protection circuit of claim 15, wherein the second circuit comprises an operational amplifier.

17. In an ion thruster engine of a type that includes a pair of spaced-apart screen and accelerator grids disposed at different voltages, a method for protecting the grids against damage caused by plasma arcing between the two grids, the method comprising:

providing an impedance coupled in series between the accelerator grid and a current return path of the accelerator grid; and, converting an increase in current in the accelerator grid caused by a plasma arc between the screen grid and the accelerator grid into a reduction of the voltage differential between the screen grid and the accelerator grid with the impedance.

18. The method of claim 17, further comprising sensing an excess voltage on the accelerator grid resulting from the plasma arc, and in response thereto, reducing the voltage differential between the screen grid and the accelerator grid.

19. In an ion thruster engine of a type that includes a pair of spaced-apart screen and accelerator grids disposed at different voltages, a method for protecting the grids against damage caused by plasma arcing between the two grids, the method comprising:

providing an impedance coupled in series between the accelerator grid and a current return path of the accelerator grid; and, varying the impedance in response to an increase of current in the accelerator grid resulting from a plasma arc between the screen grid and the accelerator grid to decouple a substantial portion of the accelerator grid current from the return path and thereby reduce the voltage differential between the screen grid and the accelerator grid.

20. The method of claim 19, further comprising sensing an excess voltage on the accelerator grid resulting from the plasma arc, and in response thereto, reducing the voltage differential between the screen grid and the accelerator grid.

* * * * *